United States Patent [19]

Geller

[11] 4,124,359

[45] Nov. 7, 1978

[54] ELECTROSTATIC PRECIPITATOR

[75] Inventor: Edward W. Geller, Mercer Island, Wash.

[73] Assignee: Flow Industries, Inc., Kent, Wash.

[21] Appl. No.: 792,653

[22] Filed: May 2, 1977

[51] Int. Cl.[2] ..... B03C 3/45

[52] U.S. Cl. ..... 55/130; 55/154

[58] Field of Search ..... 55/128, 129, 130, 136, 55/137, 151, 154

[56] References Cited

U.S. PATENT DOCUMENTS

| | | | |
|---|---|---|---|
| 1,119,469 | 12/1914 | Nesbit et al. | 55/130 |
| 1,357,202 | 10/1920 | Nesbit | 55/130 |
| 2,654,438 | 10/1953 | Wintermote | 55/129 |

FOREIGN PATENT DOCUMENTS

| | | | |
|---|---|---|---|
| 316,703 | 6/1918 | Fed. Rep. of Germany | 55/130 |
| 684,342 | 11/1939 | Fed. Rep. of Germany | 55/130 |
| 2,542,311 | 7/1976 | Fed. Rep. of Germany | 55/137 |

*Primary Examiner*—Frank W. Lutter
*Assistant Examiner*—David L. Lacey
*Attorney, Agent, or Firm*—Christensen, O'Connor, Johnson & Kindness

[57] ABSTRACT

An electrostatic precipitator is disclosed comprising a series of parallel collector electrode plates of similarly corrugated form, with the continuously curved and successive crests and valleys of the corrugations of each plate positioned in opposition to the similar crests and valleys of the adjacent plates so as to form gas-flow channels that successively converge and diverge, forming alternate narrow and wide regions along the direction of flow between each pair of plates. Of one common electrical polarity, these collector electrode plates cooperate with an array of discharge filament electrodes of opposite common polarity located between each pair of plates, with one such filament electrode centered in and extending longitudinally of each of the wide regions defined between the opposing valleys of the adjacent plates. Of critical importance to achieving the objectives of the invention, the mean spacing between plates is required to be substantially in the range from half the corrugation wave length to the corrugation wave length, and the peak-to-peak corrugation magnitude or height to be substantially in the range between ten and twenty percent of the corrugation wave length.

6 Claims, 5 Drawing Figures

Fig. 1
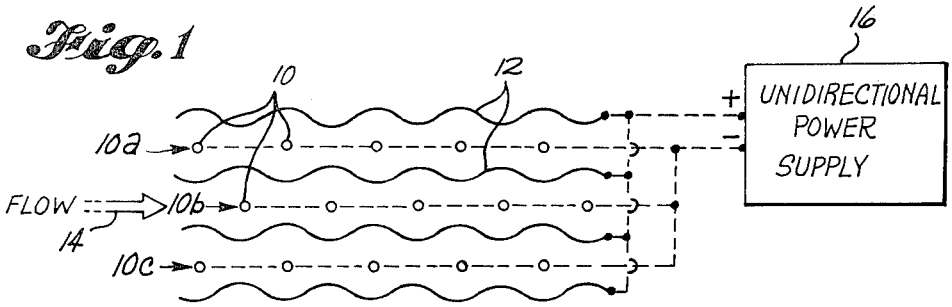
Fig. 2
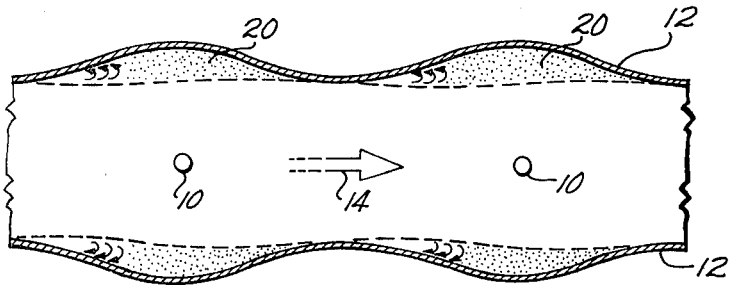
Fig. 3
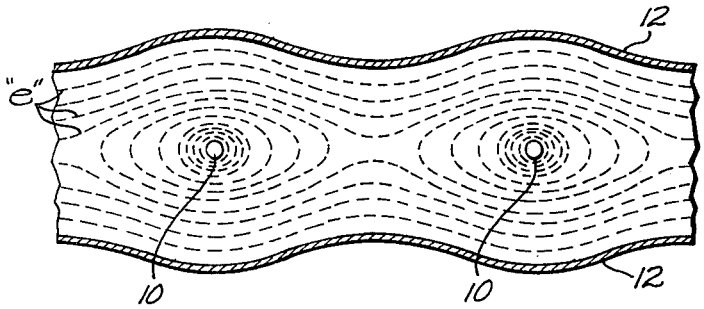
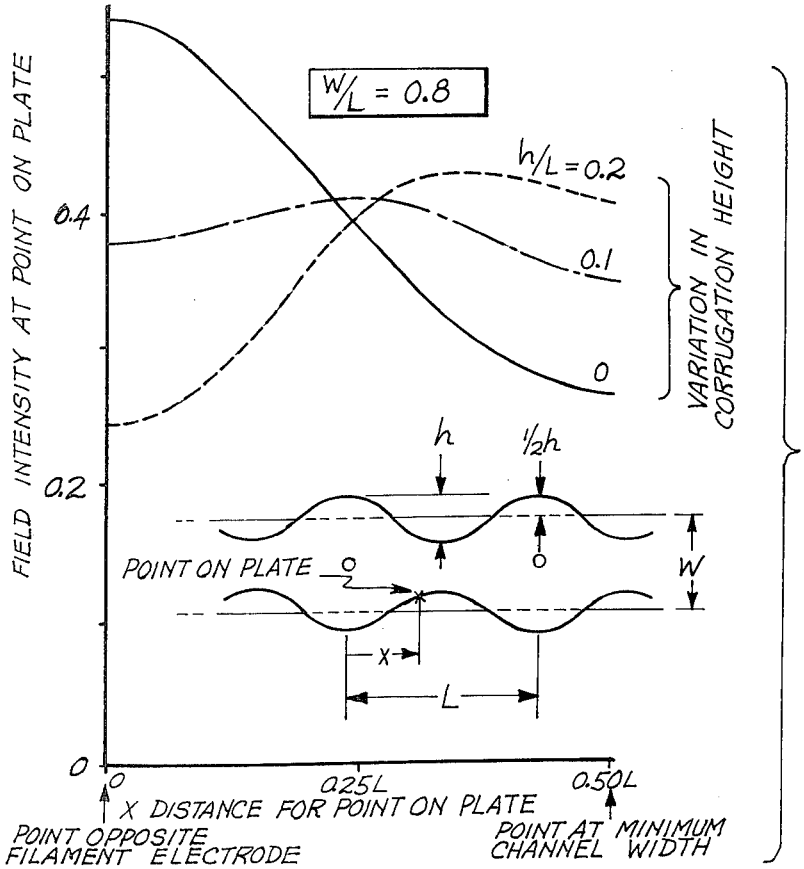
Fig. 4

ELECTROSTATIC PRECIPITATOR

BACKGROUND OF THE INVENTION

This invention relates to improvements in electrostatic precipitators, and more particularly in single-stage electrostatic precipitators of the type in which gas-borne particles subjected to the high-voltage electric field effects of discharge filament electrodes become charged so as to be attracted to and held by adjacent collector plate electrodes polarized oppositely to the discharge filament electrodes. The invention is herein illustratively described by reference to its presently preferred embodiment; however, it will be recognized that certain modifications and changes therein with respect to details may be made without departing from the essential features involved.

Certain prior art disclosures of background interest relative to such electrostatic precipitators and to an understanding of how certain prior art precipitators have operated are as follows: U.S. Pat. Nos. 1,791,338 Wintermute (1931), 2,654,438 Wintermute (1953), 3,740,925 Gothard (1973), Publications: White, H. J. "Industrial Electrostatic Precipitation", Addison-Wesley, Reading, Massachusetts, 1963. Oglesby, S. and Nichols, C. B. "A Manual of Electrostatic Precipitator Technology", Southern Research Institute, Birmingham, Alabama, 1970.

In prior art precipitators most commonly used, pairs of opposing parallel flat collector plate electrodes are provided with elongated flow interrupter ribs projecting into the flow stream at interval locations along the mutually opposing faces of the electrodes. The individual ribs extend parallel to the discharge filament electrodes also spaced at intervals along the gas flow channels between the plates. The intended effect of these flow interrupter ribs is to retard the gas flow adjacent the electrode surfaces both immediately ahead of each rib and immediately behind it thereby to minimize gas flow scouring effects causing removal and reentrainment of the particles held by the plates and also so as to afford the associated newly incident particles greater dwell time in the vicinity of the collector plates to enhance their prospect of capture. The high voltage applied between the filament and plate electrodes establishes an electric field characterized by high intensity in the region immediately surrounding the discharge filament electrodes and relatively low but nonetheless substantial intensity in the region immediately adjacent the collector plate electrodes. Sparkover, which is a sudden electrical discharge between a filament and a plate electrode, determines the upper limit for the voltage applied between these electrodes. In operation, gas-borne particles entering the corona region of the discharge filament electrodes accumulate a static charge by gathering free ions released in the corona discharge. The upper limit of this charge accumulation, reached at an equilibrium condition in the electric field, increases as the strength of the electric field is increased. Each charged particle experiences an electrostatic attraction force toward the nearest collecting electrode and of a magnitude proportional to the particle charge and to the intensity of the electric field (i.e., the voltage gradient). However, in the central core flow region between adjacent plate electrodes where the velocity is high and the flow is highly turbulent, the electrostatic force is small in relation to the aerodynamic forces that tend to make the particle follow the motion of the gas. Thus, the aforementioned electrostatic attraction force has little effect on particle position until the particle is swept by the turbulence into a region of reduced flow closely adjacent the collector plate. In this region the migration velocity induced by the electric field force dominates, and the particle is captured by the collecting electrode and by residual attraction, held in an accumulating layer. Removal of the accumulated layer of particles is commonly accomplished by periodically striking the top edge of the plates with a hammer mechanism so that large chunks or sheets of the collected material fall into hoppers below the plates. This process is called rapping. During a collector plate rap not all of the dislodged particles fall into the hoppers. Some of them are accelerated out of the region of reduced flow adjacent the plates and are reentrained into the main flow.

The separated flow regions (i.e., regions of retarded gas flow) created by the flow interruption effect of these special ribs mounted at intervals along the collector electrode plates are intended to shield the collected particle layers from direct scouring by the main flow stream and to inhibit reentrainment of the particles into the main flow, particularly during rapping. In so doing, however, the ribs also unduly impede the main flow between electrodes and seriously lower the sparkover voltage threshold of the precipitator. Sparkover threshold determines the practical upper operating limit for the applied electrode voltage, and thus the upper limit for the electric field intensity in the inter-electrode space. High electric field intensity in the particle discharge region promotes a high charge for the particles, which is desirable since the electric force on the particle is proportional to the particle charge. It is also desirable that the field intensity be high as possible in the regions near the collector electrode plates where the electrostatic forces effect capture since these forces are proportional to the field intensity. Also it is advantageous for the field to be as uniform as possible in these regions. Non-uniformity in the electric field along the surfaces of the collecting electrode plates is undesirable for two reasons. First, severe variations, such as those occurring near a sharp projection on an electrode plate, promote sparkover. Second, reduction of intensity along an electrode plate from the peak value allowed by sparkover design limitations reduces the average migration velocity of particles in the capture region and thereby the capture efficiency of the system as a whole. In general, the desirable conditions in the capture region near the collector plate are minimum gas flow velocity, highly charged particles, and a uniformly high electric field intensity. Mechanical rigidity is also desirable for the collector electrode plates in order to maintain electrode plate shape and thereby the intended precise positional relationship between opposing electrodes. Also desirable is the ability of the plate to transmit vibratory motions from rapping at the top of the plate to all parts of the collector plate.

In the above-cited "A Manual of Electrostatic Precipitator Technology", at pages 231 and 232 discharge filament electrodes are disclosed in combination with electrode plates of zig-zag, offset or corrugated configuration. However, the configurations there disclosed retain the effect of abrupt prominences that promote sparkover to the discharge filament electrodes and non-uniform electric field intensity along the electrode plate and therefore possess most of the characteristics and problem limitations of the commonly used ribbed plate electrodes discussed above. Thus although such previously disclosed configurations may bear superficial resemblance to the present invention, the referenced disclosure differs significantly from it and fails to recognize and overcome those limitations and fails to provide an enabling disclosure of this invention.

A broad object of the present invention therefore is to provide an improved configuration for the electrodes of electrostatic precipitators of the described type, and more specifically an improved configuration for the collector plate electrodes that increases the particle capture efficiency thereof and the particle retention capacity of such devices without unduly impeding the main flow through the precipitator.

A related object hereof is to provide such an improved precipitator that can be made of more compact and simpler construction hence less costly when installed than the prior art devices of the ribbed plate and filament array type described above.

A further and more specific object of this invention is to provide a more effective precipitator collector electrode plate configuration that permits the applied voltage to be increased over that usable with prior art devices of corresponding collector plate spacing, yet without exceeding the sparkover voltage threshold. A related object is to simultaneously improve the particle capture electric field pattern and the gas flow pattern in such precipitators conducive to operating efficiency and physical design compactness while providing collector electrode plates of the requisite form retention rigidity and rapping vibration transmission properties. In the attainment of such objectives not only are more highly charged particles and more intense and more effective electric field patterns obtainable, but the gas-borne particles carried into the reach of the collector plate electrodes are caused by the gas flow stream to dwell or be decelerated for a longer time period conducive to completing their migration to the attractive collector plate surfaces. Furthermore, the invention concurrently provides improved captive particle retention characteristics in such precipitators, due not only to the higher operating voltage limits attainable therein, but also due to the improved gas flow effects of the collector plate electrode configurations that reduce the scouring tendencies of gas flow otherwise presenting problems in the dislodgement and reentrainment of captive particles.

As herein used, the term "filamentary" or "filament" applied to the discharge electrodes is intended to mean and include a wire, rod, bar, cable, strip, or generally any elongated configuration that is cross-sectionally narrow in any direction relative to its length. In other words, the discharge electrode member configuration being defined is understood to be of such restricted cross-sectional dimensions in relation to the expanse between successive similar members in the same array that electric flux lines passing between the respective members and the adjacent collector plate electrodes will converge on the members and at operating voltages produce corona discharge in the immediately surrounding vicinity. A round wire or similar elongated discharge filament electrode is the simplest and preferred form of such member, but it is to be understood that other configurations are also usable within the intended definition.

The terms "corrugation" and "corrugated," as herein used with relation to the configuration of the paired collector plate electrodes or to that of the mutually opposing surfaces of such electrodes, imply curvilinear surfaces without abrupt or sharp contours that can produce undue electric field concentrations. These terms also have reference to wavy or sinously shaped surfaces, that is, surfaces that have alternate crests and intervening valleys. Preferably they are shaped as sine waves; however, surface shapes deviating somewhat from a pure sine wave may also be used. The successive alternating crests and valleys defined by these individual collector plate electrode surfaces are mutually parallel and are aligned perpendicular to the direction of gas flow past such surfaces. Moreover, in the required configuration and spatial relationship between opposing corrugated collector electrode plate surfaces the crests of one oppose the crests of the other so as to form flow channels that alternately converge and diverge along the direction of flow, and such corrugation alignment is herein said to be of opposite phasing. The terms divergence-convergence region and convergence-divergence region, as used herein, respectively refer to a wide portion and a narrow portion of the channel between opposing corrugated collector plates.

The term "corrugation height" as herein used refers to the distance between a crest peak and a valley low point measured normal to the mean plane of a corrugated surface, and the term "corrugation wave length" refers to the distance between successive peaks.

BRIEF DESCRIPTION OF INVENTION

In accordance with this invention, the desired objectives are achieved in an electrostatic precipitator wherein the collector plate electrodes of each pair associated with an intervening array of discharge filament electrodes are of corrugated configuration, the corrugations being of opposite phasing. The individual discharge filament electrodes are centrally located in the wide or divergence-convergence regions between corrugated opposing collector plate electrode surfaces. Of unique significance, moreover, the spacing between such surfaces and the corrugation height and corrugation wave length are so selected within certain ranges as to produce substantially uniform electric field distribution along the collector plate surfaces throughout the crests and valleys thereof so as to achieve maximum average field intensity attracting the particles charged by the corona effects in the vicinity of the individual discharge filament electrodes. Furthermore, in addition to such field uniformity, the corrugations produce gas flow patterns that provide the desired flow deceleration and dwell-time of the particles in the regions immediately adjacent the collector plate's corrugation surface valleys so as to maximize the migration and capture of particles on such surfaces without otherwise materially impeding the main flow of gas through the device.

In the foregoing manner the mean spacing between collector plate surfaces may be reduced for a given operating voltage, or the operating voltage may be increased for a given such spacing without exceeding the sparkover threshold. Moreover, the length of the device in the direction of gas flow may be reduced while achieving the same effective surface area on which to collect the particles with consequently reduced physical size of the device in terms of both length and width.

In addition, the corrugated configuration of the collector plate electrodes provides inherent mechanical rigidity needed to maintain plate shape when hung in place and to transmit vibratory motions from rapping to all parts of the collector plate, thus avoiding the necessity of stiffener ribs to achieve physical stability, thereby reducing costs of manufacture.

These and other features, objects and advantages of the invention will become more fully evident from the following description thereof by reference to the accompanying drawings.

BRIEF DESCRIPTION OF DRAWINGS

FIG. 1 is a simplified schematic edge view of an electrostatic precipitator incorporating this invention.

FIG. 2 is a fragmentary view of such a precipitator illustrating the gas flow patterns and resulting flow separation and dwell-time effect on the particles passing between opposing corrugated collector plate electrodes.

FIG. 3 is a fragmentary edge view of opposing collector plate electrodes of this invention illustrating a typical electric field pattern created between the opposing discharge filament electrodes and collector plate electrodes. Lines of constant electric potential are shown.

FIG. 4 is a graph of the electric field intensity at the collector plates as a function of position along the plates for an inter-plate spacing which is eighty percent of the corrugation wave length and for different ratios of corrugation height to corrugation wave length.

DETAILED DESCRIPTION WITH REFERENCE TO DRAWINGS

Figure 5:
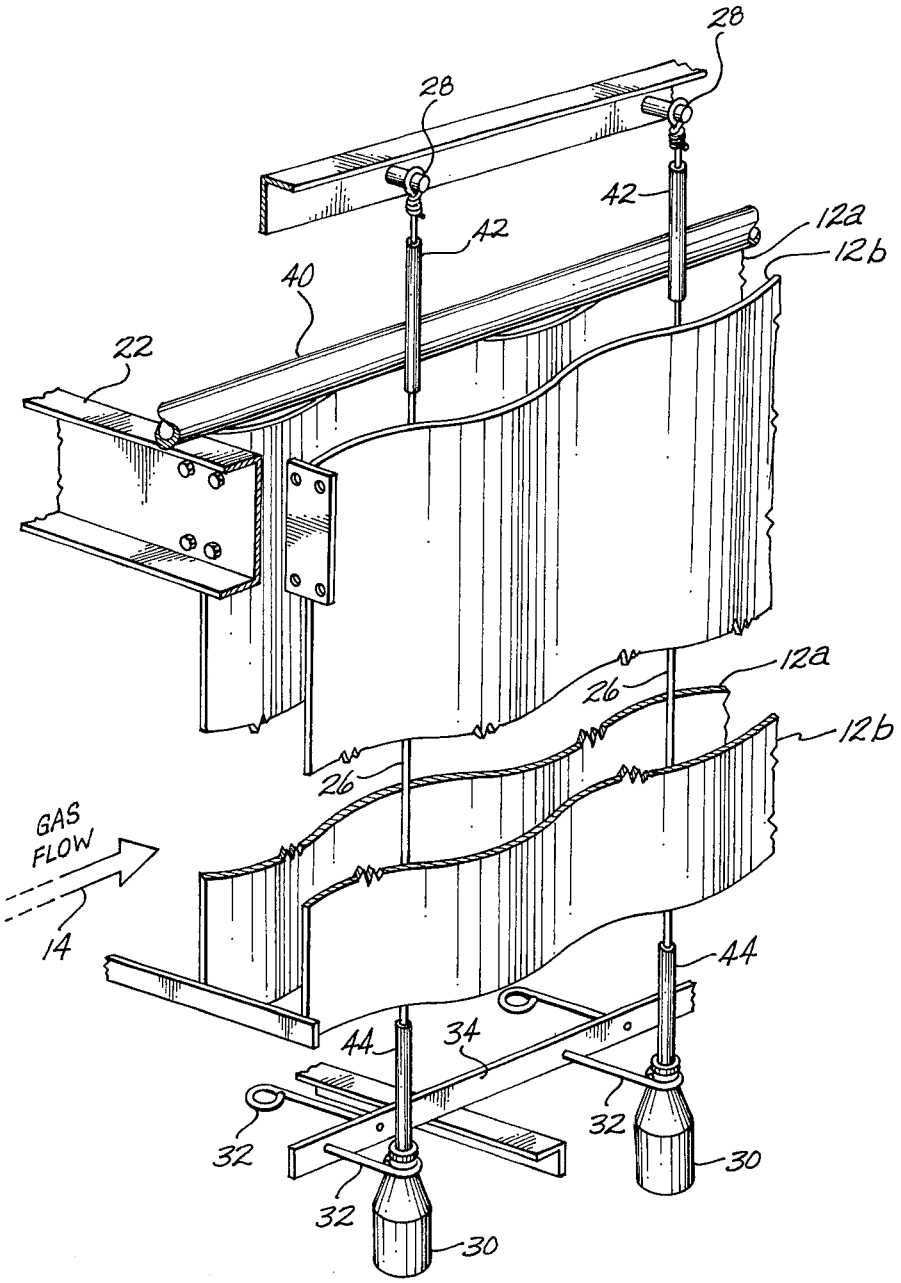
FIG. 5 is a fragmentary perspective view of a precipitator incorporating this invention using the same general type of construction as depicted in White, H. J. (supra).

In the illustrated electrostatic precipitator, the individual discharge filament electrodes 10 are positioned at regularly spaced intervals in parallel linear arrays 10*a*, 10*b*, 10*c*, etc. interposed centrally between opposing pairs of corrugated collector plate electrodes 12. The individual discharge filament electrodes of each array are located centrally in the divergence-convergence or widest regions between opposing electrode surfaces hence the filaments of each array are staggered or offset in relation to those of adjacent arrays. With reference to FIG. 1, it will be noted that for a given depth between the high and low points resulting from the collector plate shape, and for a given distance between the high point of one plate and that of an adjacent plate, the space occupied by a stack of corrugated electrode plates is less than that of a stack of an equal number of ribbed plates used in the prior art. In fact, for a given precipitator capacity the aggregate thickness will be less. A unidirectional high voltage power supply 16 has positive and negative output terminals connected respectively to the collector plate electrodes and to the discharge filament electrodes. As the case with prior art precipitators the polarity of the electrodes can be reversed with attendant loss in precipitator efficiency but with the elimination of ozone production which may be undesirable for some applications.

With reference to FIGS. 2 and 3, it will be noted that the opposing corrugations of collector plate electrodes 12 in each pair are of opposite physical phasing and the flow of gas confined laterally between opposing electrodes is perpendicular to the direction of the crests and valleys formed by these electrodes. This is also shown in FIG. 5. The variables in the corrugation pattern of the collector plate electrodes include the spacing W between plates (see FIG. 4), the corrugation height *h*, and the corrugation wave length L.

As will be seen in the drawings, these corrugations may be formed in relation to the physical positionings of the discharge filament electrodes so as to create substantially uniform field intensity along the path of gas flow adjacent the collector plate electrodes while providing intense fields in the inter-electrode space. In FIG. 3, the lines *e* represent lines of constant electrical potential and thereby illustrate the electric field distribution between the discharge filament electrodes 10 and the associated collector plate electrodes 12. In this type of illustration the spacing between adjacent lines of equal potential is inversely proportional to the potential gradient (i.e., the electric field intensity). Consequently, as will be seen in FIG. 3, the substantially uniform spacing between successive lines of equal potential immediately adjacent the collector plate electrodes indicates that with the corrugated configuration and spacing of these electrodes substantially uniform electric fields are attainable along the length of such electrodes, hence maximum attractive force is available at all points to capture and hold the charged particles. The gradualness of the surface undulations at the crests of corrugated plate electrodes avoids the high electric field concentrations which are associated with ribs projecting from collector plate electrodes used heretofore and which promote electrical breakdown or sparkover.

As will be seen in FIG. 1, corrugation of the electrodes increases the collector plate surface area, and the stacking arrangement provides for efficient space utilization.

In FIG. 2 it will also be seen that the corrugated configuration of the collector plate electrodes also enhances the operating efficiency of the device by creating flow separation pockets or regions of decelerated particle movement in the regions 20 immediately downstream of the corrugation crests. In these valley regions of the corrugations the flow is retarded and the particles move slowly as desired, yet the disruption effect of the corrugations on the main stream is minimal, yet the gradualness of the collector plate surface undulations at the crests avoids the relatively violent and partially self defeating eddying swirl effects produced by sharp ribs projecting from flat collector plate electrodes heretofore used.

As depicted in FIG. 4, for which an example value of 0.8 has been chosen for the ratio of collector plate spacing W to collector plate corrugation wave length L, it will be seen that a flat plate, corresponding to an *h* to L ratio of zero, produces large variation in field intensity along the plate surface (not that $x = 0$ corresponds to a point opposite the wire filament). This variation is undesirable because the particles moving along the collector plate surface pass alternately through intense fields and weak fields. Inasmuch as the magnitude of the intense fields is limited by the electrical breakdown or sparkover characteristics of the device, the weak fields are necessarily less than those attainable and the average is correspondingly also less. Since these fields effect particle capture, the precipitator looses efficiency.

The variation in surface electric field intensity with $x$ distance along a flat collector plate is particularly undesirable since the peak intensities occur at the points on the collector plate opposite filament electrodes (at $x = 0$), a condition that reduces the sparkover voltage. It will be seen from FIG. 4 that for the example plate spacing chosen ($W/L = 0.8$), the variation with $x$ is nearly eliminated when a corrugation is used in the collector plate such that the corrugation height *h* is one tenth of the wave length L. Increasing the corrugation height to values greater than one tenth the wave length overcompensates in so far as the point of maximum electric field intensity for the flat plate case becomes the point of minimum intensity for the corrugated collector plate case. A small over-compensation can be used without significantly decreasing the sparkover threshold voltage (in fact, over-compensation with a properly shaped nonsinusoidal wave form can slightly increase the sparkover threshold for a given average surface field intensity) while simultaneously improving the gas flow characteristics since flow separation at the corrugation crests becomes more assured and the region of separated flow becomes deeper as the corrugation amplitude is increased.

Graphs similar to those shown in FIG. 4 and for plate spacings other than eight tenths of the corrugation wave length, show that the corrugation height for minimum variation of field intensity is approximately one-tenth of the wave length for plate spacings between one-half and one corrugation wave length. A corrugation height *h* between 10 and 20 percent of the wave length L is recommended, the choice being partly dictated by the gas flow requirement of assured flow separation near the corrugation crests and sufficient corrugation valley depth for protection from core flow turbulence as depicted in FIG. 2. In general, an increase in the design value for the ratio W/L will require an increase in the design value for the ratio *h*/L if the same tendency for the flow to separate at the corrugation crests is to occur.

In FIG. 5 it will be noted that the collector plate electrode sheets 12*a* and 12*b* are mounted on supports 22 with the corrugation crests and valleys extending vertically. The successive discharge filament electrodes 26 comprise weighted wires suspended from overlying supports 28, with the wires tensioned by insulative weights 30 hung on their lower ends positionally steadied by located shackles 32 projecting from the machine frame member 34. Stabilizer rods or bars 40 extend along and joined to the upper edges of the plates 12*a*, 12*b*, etc. may be used to help keep them parallel and at constant average spacing; and also serve as an anvil or means upon which to rap in order to jar particle accumulations loose from the plates. Insulator sleeves 42 and 44 placed around the electrodes 26 at their upper and lower ends are preferably employed as a means to prevent sparkover to adjacent frame members. The general configuration and construction of such a precipitator is or may be similar to that depicted in H. J. White (supra). Other configurations and mounting arrangements are also possible as will be evident from an understanding of the operating and constructional principles of this invention.

Having described the invention by reference to its presently preferred embodiment and in accordance with presently understood and preferred objectives and features, it will be appreciated that the invention is not intended to be deemed limited by the example but by the following claims construed within the broad and novel teachings of this disclosure.

What is claimed is:

1. Electrostatic precipitator apparatus operable to capture particles borne by gas flowing in a selected direction through said apparatus, comprising mutually opposed first and second collector plate electrodes mounted in spaced parallel relationship defining therebetween a laterally confined path for said directional flow of gas through the apparatus, said collector plate electrodes being of similarly corrugated surface form arranged with the alternate smoothly curved crests and valleys of each in direct opposition to the corresponding crests and valleys of the other and longitudinally extending substantially at right angles to the direction of said gas flow between said collector plate electrodes, an array of parallel successively spaced discharge filament electrodes mounted midway between and extending in parallel relationship with said collector plate electrodes with the individual discharge filament electrodes extending centrally lengthwise of individual divergence-convergence spaces defined by and between opposing valleys of said collector plate electrodes, the corrugation wave length of said collector plate electrodes in relation to the corrugation height and mean spacing between said collector plate electrodes being such as to place the discharge filament electrodes at approximately uniform spacing from the valley-defining surfaces respectively adjacent thereto, and means for applying unidirectional voltage to said electrodes including connections of one polarity to said collector plate electrodes in common and connections of opposite polarity to said discharge filament electrodes in common, the mean spacing between said mutually opposing collector plate electrodes being substantially one-half to one times the corrugation wave length of said collector plate electrodes and the height of said corrugations between valley and crest peaks being between substantially ten and twenty percent of said wave length.

2. The apparatus defined in claim 1, wherein the corrugation periodicity of the collector plate electrodes is constant.

3. The apparatus defined in claim 2, wherein the corrugations are of substantially sinusoidal form.

4. The apparatus defined in claim 3, wherein the discharge filament electrodes are located in each of the successive divergence-convergence spaces.

5. The apparatus defined in claim 1, including a conductive sheet of corrugated form having opposed faces one of which comprises the second collector plate electrode and the other of which comprises a third collector plate electrode, said apparatus further including means comprising a fourth collector plate electrode mounted in spaced parallel relation to said third collector plate electrode so as to define therebetween a second laterally confined path for said directional flow of gas through the apparatus, said fourth collector plate electrode being of similarly corrugated surface form arranged with the alternate crests and valleys thereof in direct opposition to those of said third collector plate electrode, a second array of parallel successively spaced discharge filament electrodes mounted midway between and extending in parallel relationship with those of the first-mentioned array, with the individual electrodes of said second array extending centrally lengthwise of individual divergence-convergence spaces defined by and between opposing valleys of said third and fourth collector plate electrodes, the corrugation wave length of said third and fourth electrodes in relation to the corrugation height and mean spacing between said third and fourth electrodes being such as to place the discharge filament electrodes at approximately uniform spacing from the valley-defining surfaces respectively adjacent thereto, said power supply means connections placing all collector plate electrodes at one common polarity potential and all discharge filament electrodes at one common opposite polarity potential.

6. The apparatus defined in claim 5, wherein the discharge filament electrodes of said first and second arrays are located in each of the successive divergence-convergence spaces.

* * * * *

UNITED STATES PATENT AND TRADEMARK OFFICE

CERTIFICATE OF CORRECTION

PATENT NO. : 4,124,359

DATED : November 7, 1978

INVENTOR(S) : Edward W. Geller

It is certified that error appears in the above-identified patent and that said Letters Patent are hereby corrected as shown below:

Column 6, line 52: delete "not" and insert therefor —note—.

Signed and Sealed this

*Thirteenth* Day of *March 1979*

[SEAL]

*Attest:*

RUTH C. MASON
*Attesting Officer*

DONALD W. BANNER
*Commissioner of Patents and Trademarks*